United States Patent [19]

DeMarco

[11] 4,007,753

[45] Feb. 15, 1977

[54] FOLDING UMBRELLA

[76] Inventor: Joseph H. DeMarco, 60 Seaman Ave., New York, N.Y. 10034

[22] Filed: Jan. 22, 1976

[21] Appl. No.: 651,475

[52] U.S. Cl. ..... 135/25 R; 135/25 A; 135/27

[51] Int. Cl.[2] ..... A45B 19/10

[58] Field of Search ..... 135/25 R, 25 A, 27

[56] References Cited

UNITED STATES PATENTS

| | | | |
|---|---|---|---|
| 897,195 | 8/1908 | Dague | 135/25 A |
| 1,175,597 | 3/1916 | Burnham | 135/25 R |
| 1,964,292 | 6/1934 | Livingston | 135/27 |
| 3,457,931 | 7/1969 | Shomizu | 135/25 R |
| 3,902,514 | 9/1975 | Weber | 135/27 X |

*Primary Examiner*—Werner H. Schroeder
*Assistant Examiner*—Conrad L. Berman
*Attorney, Agent, or Firm*—Bauer, Amer & King

[57] ABSTRACT

A folding umbrella of the type in which a lower section closes upon an upper section, as both these sections close upon the umbrella rod, and wherein this closing movement is automatically achieved, i.e. is the result of articulating or pivotal movement of the umbrella ribs, rather than being movement that must be manually imparted.

2 Claims, 7 Drawing Figures

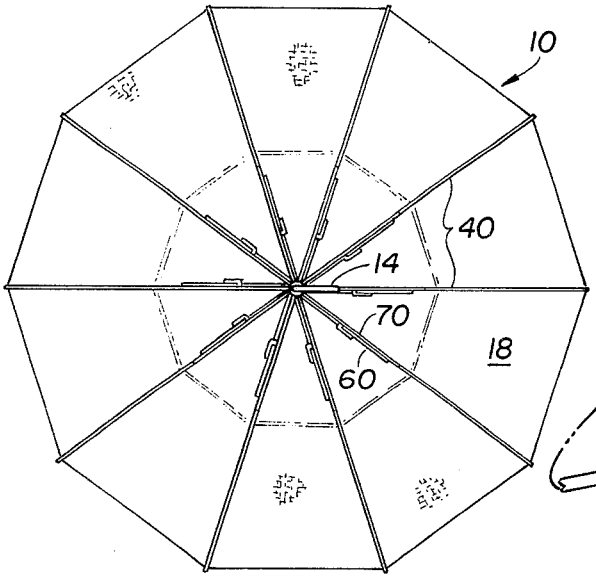
FIG. 2
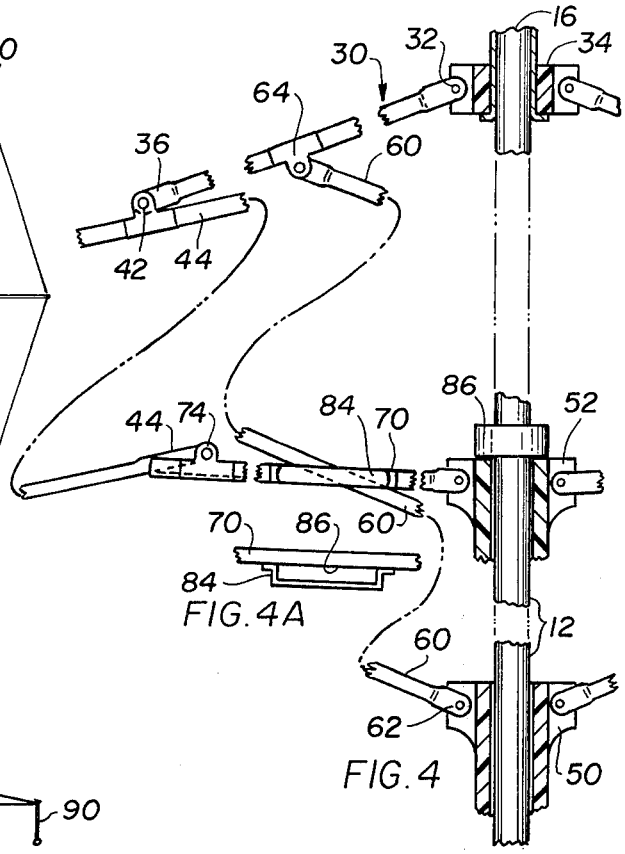
FIG. 4A
FIG. 4
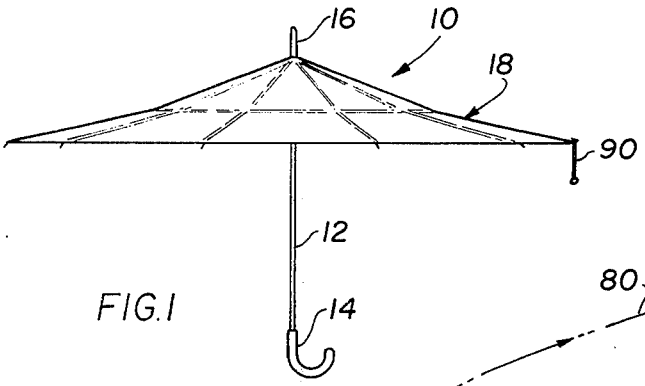
FIG. 1
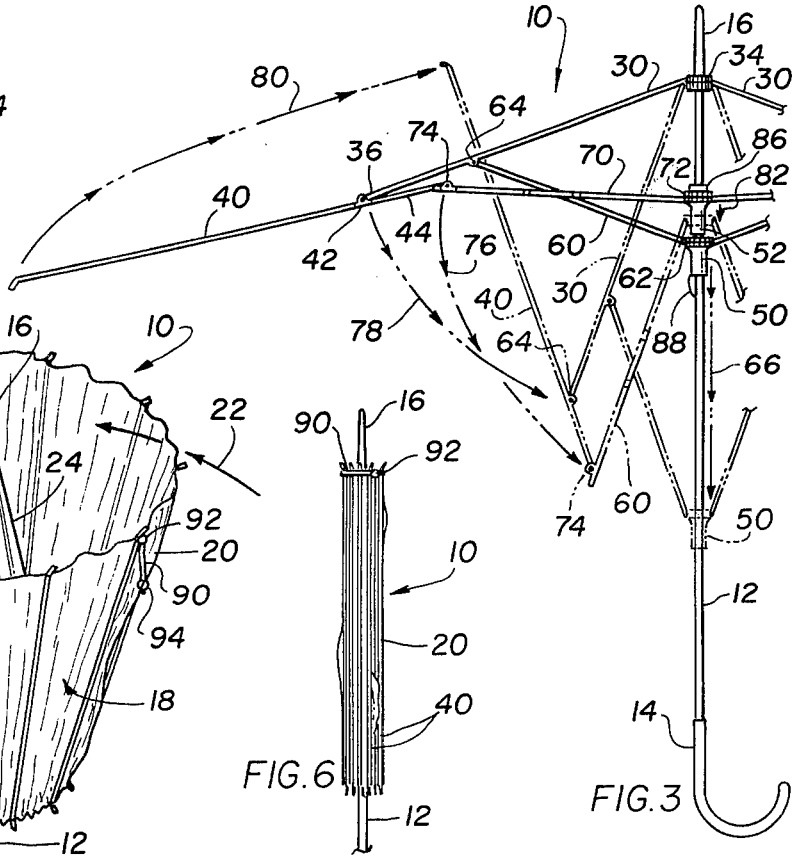
FIG. 3
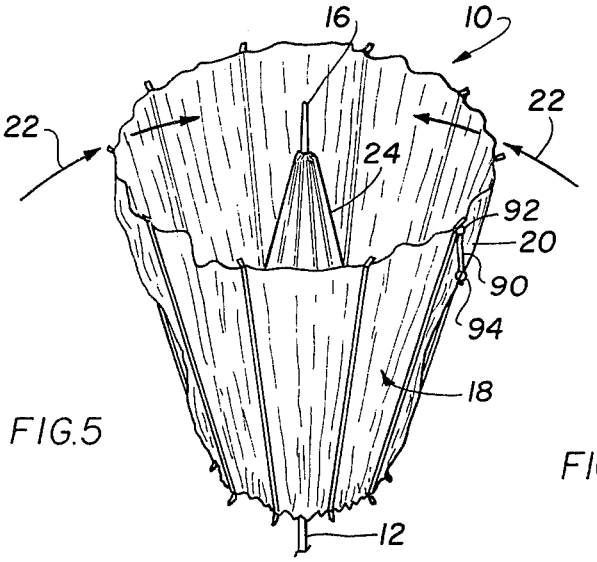
FIG. 5
FIG. 6

FOLDING UMBRELLA

The present invention relates generally to umbrellas, and more particularly to an improved folding umbrella, in the closing of which, the collapse of all of the ribs is achieved automatically, rather than manually, either entirely or even in part.

As generally understood, it is already well known, as exemplified by the umbrella of U.S. Pat. No. 1,964,292, among others, that an advantageous compact umbrella storage condition can be achieved by allowing for pivotal movement of a lower umbrella section upon an upper section, as these sections are closed upon the umbrella rod. In addition to the noted compact storage condition, this also projects the normally dry undersurface of the lower umbrella section to the outside, and thus does not wet or otherwise soil clothing or the like contacting the umbrella. These known folding umbrellas are in common use, even though the folding movement of the lower section, after collapse of the rib structure, must be achieved manually. This manual folding operation, moreover, is often inconvenient to perform because the lower section of ribs, which extend circumferentially from about the umbrella, must be gripped, usually one at a time and folded, and then held as each other rib is successively gripped and folded.

Broadly, it is an object of the present invention to provide an improved folding umbrella overcoming the foregoing and other shortcomings of the prior art. Specifically, it is an object to cause complete "automatic" collapse of the umbrella rib structure, and yet maintain a desirable degree of structural rigidity in the ribs in their open condition; thus, the collapse referred to is not at the expense of lessening the support afforded by said ribs.

An improved folding umbrella demonstrating objects and advantages of the present invention includes a central umbrella rod having at opposite ends a handle and an operative distal end and defining a path of movement therealong between said handle and distal end, and rib structure comprised of a first set of plural circumferentially spaced umbrella cover-supporting ribs each operatively pivotally mounted at one end adjacent said distal end of said rod and presenting opposite operative ends, and a second set of plural umbrella cover-supporting ribs cooperating with said first set which are each at locations spaced from one end to provide a fulcrum pivotally attached to a cooperating operative end of one said rib of said first set. Also disposed on the rod are upper and lower slide members which respectively support one end of two sets of rib movement-actuating braces. Specifically, there is a first set of plural braces pivotally connected between a cooperating rib of said first set of ribs and said lower slide member so as to partake of pivotal umbrella opening and closing movements in response to ascending and descending sliding movements respectively of said lower slide member, and a second set of plural braces each pivotally connected between said fulcrum end of a cooperating rib of said second set of ribs and said upper slide member so that during initial descending sliding movement of said lower sliding member preparatory to umbrella closing movement of said first and second sets of ribs there is caused a corresponding initial sliding movement in said upper sliding member effective to initiate clockwise pivotal movement in said fulcrum ends of said second set of ribs. The consequence of the foregoing is that in response to continued descending sliding movement of said lower sliding member, said first and second sets of ribs close upon each other as well as upon said umbrella rod.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein:

FIG. 1 is a side elevational view of the within improved umbrella in its open condition;

FIG. 2 is a bottom view of said umbrella;

FIG. 3 is a partial side elevational view, on an enlarged scale, with the weather barrier cover removed to better illustrate the cover-supporting ribs, and wherein the positions of pivotal movement of said ribs in their open and closed positions are illustrated in full line and phantom line perspective;

FIG. 4 is a partial side elevational view illustrating how the ribs and braces of the umbrella are cooperatively assembled with each other;

FIG. 4A is a detailed bottom view illustrating a slot formed on one of the umbrella braces;

FIG. 5 illustrates how the umbrella folds into its closed condition, wherein two halves or sections of the umbrella close upon each other while both said sections close upon the umbrella rod; and FIG. 6 illustrates the within umbrella in its completely folded or closed condition.

FIGS. 1, 2, demonstrate that the within umbrella, generally designated 10, is conventional to the extent of including the usual umbrella rod 12 having at one end a handle 14 and at its upper distal end 16 a plurality of circumferentially spaced ribs, to be described in greater detail subsequently, which support a weather barrier or cover 18 of suitable material, such as fabric, plastic, or the like. The within umbrella 10 is the type which has a compact folded storage condition, as illustrated in FIG. 6. More particularly, as illustrated in FIG. 5, the lower portion or section of the cover 18, more particularly designated 20, folds up in the direction 22 against an upper section 24, as both sections 20, 24 fold against the rod 12. As a consequence, the cover 18 naturally takes only half as much space as it would otherwise, and also the dry "inside" surface of the lower section 20 is placed in an outwardly facing relation, rather than the opposite "weather" side of the cover 18 which is apt to be wet following a typical use.

Although the umbrellas having the performance just described are already well known, as exemplified by the umbrella of U.S. Pat. No. 1,964,292, in these known umbrellas it is necessary that the lower section 20 be folded manually against the upper section 24 in order to achieve the umbrella compact storage condition of FIG. 6. As a significant advance over these known umbrellas, the within umbrella 10, by virtue of its structural features and the cooperative relation of these structural features, is effective during the closing of the umbrella to have the lower section 20 close upon the upper section 24 automatically, and further to have the sections 20, 24 automatically close upon the umbrella rod 12 to provide said desirable compact storage condition of FIG. 6. By "automatic" is meant that in the closing of the umbrella, the articulation or folding movement 22 of the lower umbrella section 20 upon the upper section 24 necessarily results because of mechanical linkage embodied in the umbrella 10, as will now be described in detail.

This mechanical linkage, as best shown in FIG. 3, includes a first set of plural circumferentially spaced umbrella cover-supporting ribs, individually and collectively designated 30. Each rib 30 of this first set is pivotally connected, as at 32, adjacent the umbrella distal end 16 to a fixed hinge 34 mounted at the location illustrated on the umbrella distal end 16. In the open condition of the umbrella, as illustrated in full line in FIG. 3, each rib 30 extends from the pivot 32 in a slightly downwardly inclined angular orientation and presents opposite operative ends 36 in circumferentially spaced relation about the axis of the rod 12.

A second major component of the umbrella 10 hereof includes a second set of umbrella cover-supporting ribs, individually and collectively designated 40. Each rib 40 is pivotally connected to a cooperating one of the ribs 30, and more particularly to an operative end 36 of said rib 30, and the point of interconnection is selected to be at a point spaced inwardly of an end, as at 42, so as to provide a fulcrum length 44 for each rib 40, the significance of which fulcrum length 44 will soon be apparent.

Slidably disposed for movement along the path defined by the cylindrical body of the rod 12 are two slide members 50 and 52 which are arranged in the superposed relation illustrated.

Cooperating with the lower slide member 50 is a first set of circumferentially spaced braces, individually and collectively designated 60. Each brace 60, as illustrated in FIG. 3, is connected in spanning relation between the lower slide 50, as at 62, and point 64 of a cooperating one of the ribs 30. The connections made at the locations 62 and 64 are pivotal, so that in response to descending movement 66 of the lower slide member 50 the ribs 30 close against the rod 12, all as is illustrated in full line and phantom line perspective in FIG. 3. Likewise, in response to opposite or ascending movement of the lower slide 50, the ribs 30 are urged through umbrella opening movement and assume the position of movement illustrated in full line in FIG. 3.

Completing the construction of the mechanical linkage of the umbrella 10 is a second set of circumferentially spaced braces, individually and collectively designated 70. Each brace 70 is pivotally connected at its opposite ends, as at 72 and 74, respectively, to the upper slide member 52 and to the end of the fulcrum length 44 of each rib 40. It is one of the important contributions of the within invention to recognize that the support brace 70 of each rib 40 requires pivotal connection to a movable member, such as slide 52, rather than to a stationary hinge. The reason is that in the open condition of the umbrella, in which rib 40 serves as an extension for a cooperating rib 30, rigidity of construction requires that the innermost end 74 of each rib 40 assume a slightly elevated condition in relation to the operative end 36 of the rib 30. Also, to obviate any tendency in the rib 40 to inadvertently rotate clockwise about the pivot connection 42 in the open condition of the umbrella, the holding brace 70 must be held in the horizontally oriented condition illustrated to prevent inadvertent movement of said end 76. However, when it is desired to place the umbrella 10 in its compact folded condition, an unlocking or unhinging movement is required in the brace 70 which could not be obtained if the end 72 of each brace 70 was made to a stationary hinge member. It is therefore significant that since it is slide member 52 which supports the end 72 of each brace 70, that said slide member 52 can descend slightly, as illustrated in phantom perspective in FIG. 3, when the main or lower slide member 50 is urged through movement 66 preparatory to closing the umbrella 10. As a consequence, not only does the end 72 of brace 70 descend, but also the end 74. The descent of the end 74 is, of course, effective in urging the rib 40, and more particularly the fulcrum length 44 thereof, through an initial clockwise pivotal movement in relation to the pivot 42. This movement is designated 76 in FIG. 3. Simultaneously with movement 76, the rib ends 36 of ribs 30 are urged through closing movement 78. From the foregoing, it should be readily apparent that in response to descending movement of slide member 50, and just as important, in response to an initial descending movement in slide member 52, that the upper section of ribs 30 are urged through pivotal movement about the pivots 32 and close upon the rod 12 and that the lower section of ribs 40 are urged through clockwise pivotal movement about pivots 42 and thus partake of closing movement in relation both to the umbrella rod 12 and the upper section of ribs 30.

As is perhaps best illustrated in FIG. 3, after an initial descending movement in the slide member 52, denoted by the reference numeral 82 and by the full line and phantom line perspective of said member 52, there is no further descending movement of the slide member 52 along the rod 12, since the sliding movement 82 is sufficient to lower the rib end 74 of the ribs 40 below the pivot 36, thereby enabling the ribs 40 to be urged through closing movement 80 in a clockwise rotation relative to the pivots 42.

In FIGS. 4, 4A, the linkage just described in conjunction with FIG. 3 is illustrated on an enlarged scale. These figures also illustrate the crossing relation of the braces 60 and 70. In accordance with the present invention, and as is perhaps best shown in FIG. 4A, at the intersection of said braces an interfitting or interconnecting structure is provided which contributes to the rigidity of the cover-supporting ribs 30, 40. Specifically, in the preferred embodiment as illustrated, each brace 70 has a slot-forming member 84 appropriately connected to it, as by welding or the like. The operative position of each brace 60 is one in which it is projected through the generally rectangular slot 86 formed by the member 84, and thus each cooperating pair of braces 60 and 70 is confined in its movement to prescribed movement paths during opening and closing movement of the umbrella 10.

Completing the umbrella 10 is a stop 86, appropriately stationarily mounted on the rod 12 which limits the ascending movement of the upper slide member 52. A conventional spring-operated catch 88 embodied in the rod 12 is strategically located to hold the lower slide 50 in its uppermost position of movement when umbrella 10 is open. Catch 88 is, of course, depressed within the rod 12 preparatory to closing of the umbrella 10. The distance between the catch 88 and the stop 86 is of a sufficient selected extent to allow the slide members 50 and 52 to occupy superposed positions, as illustrated in FIG. 3, when the umbrella 20 is open. Also, if slide member 50 is moved through descending movement 66 during the closing of the umbrella 10, it will be understood that the length portion which it vacates between the catch 88 and the lower portion of the slide 52 is sufficient to allow the previously noted initial descending movement 82 in the slide member 52 which, in the manner already described, results in the initial clockwise movement in the lower section of ribs 40 during closing movement 80 thereof.

From the foregoing description, it should be readily appreciated that umbrella 10 hereof readily assumes the compact storage condition illustrated in FIG. 6 automatically in response to descending movement 66 of the slide member 50. For appearance sake, an elastic band 90 having a button 92 at its attached end, and a ring 94 at its free end is secured in a looped relation about the upper portion of the ribs 40 to assist in holding it in its closed condition. As already noted, not only is the closed condition of the umbrella compact for storage, but the normally dry undersurface of the umbrella section 20 is projected to the outermost position, and thus does not wet or otherwise soil clothing or the like brought in contact therewith. These and other advantages, as already indicated, are the result of the closing, in automatic fashion, of the ribs 30 and 40 upon themselves and also upon the umbrella rod 12.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. An improved folding umbrella comprising a rod having at opposite ends a handle and an operative distal end and defining a path of movement therealong between said handle and distal end, a folding and unfolding cover for said umbrella, a first set of plural circumferentially spaced umbrella cover-supporting ribs each operatively pivotally mounted at one end adjacent said distal end of said rod and presenting opposite operative ends, a second set of similarly circumferentially spaced plural umbrella cover-supporting ribs cooperating with said first set by serving as a radial extension thereof which are each at locations spaced from one end to provide a fulcrum pivotally attached to a cooperating operative end of one said rib of said first set, upper and lower slide members disposed on said rod for sliding movement therealong, a first set of plural braces pivotally connected in spanning relation in the plane of said first and second sets of ribs between a cooperating rib of said first set of ribs and said lower slide member so as to partake of pivotal umbrella opening and closing movements in response to ascending and descending sliding movements respectively of said lower slide member, a second set of plural braces each pivotally connected substantially in said same plane as said first set of braces in spanning relation between said fulcrum end of a cooperating rib of said second set of ribs and said upper slide member so that during initial descending sliding movement of said lower sliding member preparatory to umbrella closing movement of said first and second sets of ribs there is caused a corresponding initial sliding movement in said upper sliding member effective to initiate clockwise pivotal movement in said fulcrum ends of said second set of ribs, each brace from said first set having a criss-crossing relation with a brace from said second set in said open condition of said umbrella, and at each said location where said cooperating braces criss-cross one said brace has a slot formed therein and said other brace has an operative position projected through said slot, whereby in response to continued descending sliding movement of said lower sliding member said first and second sets of ribs close upon each other as well as upon said umbrella rod.

2. An improved folding umbrella as claimed in claim 1 including a stop and a catch means in spaced apart relation on said umbrella rod, said stop limiting ascending movement of said upper slide member and said catch means selectively holding said lower slide member in its ascended position of sliding movement, said spacing between said stop and catch means being sized to accommodate said first and second slide members therebetween.

* * * * *